US006138926A

United States Patent [19]

Russo

[11] Patent Number: 6,138,926

[45] Date of Patent: Oct. 31, 2000

[54] DETERSIVE FOAM PRODUCER AND EXPELLER PNEUMATIC MACHINE

[76] Inventor: Marsio Juan Russo, Gral. Savio 2431, 1650 Villa Maipù, Buenos Aires, Argentina

[21] Appl. No.: 09/413,240

[22] Filed: Oct. 7, 1999

Related U.S. Application Data

[63] Continuation of application No. PCT/EP98/02011, Apr. 7, 1998.

[30] Foreign Application Priority Data

Apr. 8, 1997 [AR] Argentina ..... 1 01378

[51] Int. Cl.[7] ..... B05B 7/26

[52] U.S. Cl. ..... 239/310; 239/317; 239/349; 239/364; 239/365; 239/366; 239/368; 239/369

[58] Field of Search ..... 239/310, 311, 239/317, 349, 364, 365, 366, 367, 368, 369, 355, 363, 329, 331

[56] References Cited

U.S. PATENT DOCUMENTS

| | | | |
|---|---|---|---|
| 561,483 | 6/1896 | Bryce | 239/366 X |
| 2,792,258 | 5/1957 | Huber | 239/317 X |
| 2,843,137 | 7/1958 | Federighi et al. | 239/317 X |
| 3,961,754 | 6/1976 | Kuhns et al. . | |
| 4,278,132 | 7/1981 | Hostetter | 239/310 X |

FOREIGN PATENT DOCUMENTS

| | | |
|---|---|---|
| 2205510 | 12/1988 | United Kingdom . |
| WO 88/07895 | 10/1988 | WIPO . |
| WO 97/13591 | 4/1997 | WIPO . |

*Primary Examiner*—Lesley D. Morris
*Assistant Examiner*—Robin O. Evans
*Attorney, Agent, or Firm*—Shlesinger, Arkwright & Garvey LLP

[57] ABSTRACT

A detersive foam producer and expeller pneumatic machine characterized by a main conduit formed by two sections coupled to both mouths of a flow regulator valve, each having a corresponding smaller shunt, of which the front section shunt connects up a pneumatic pressure regulator and the shunt corresponding to the rear section is connected to a diaphragm pneumatic pump by its outlet mouth, the pump being in connection with a suction hose coming from a container of detersive solution, and the final end of main conduit connected to the ejection hose.

3 Claims, 1 Drawing Sheet

FIG.1
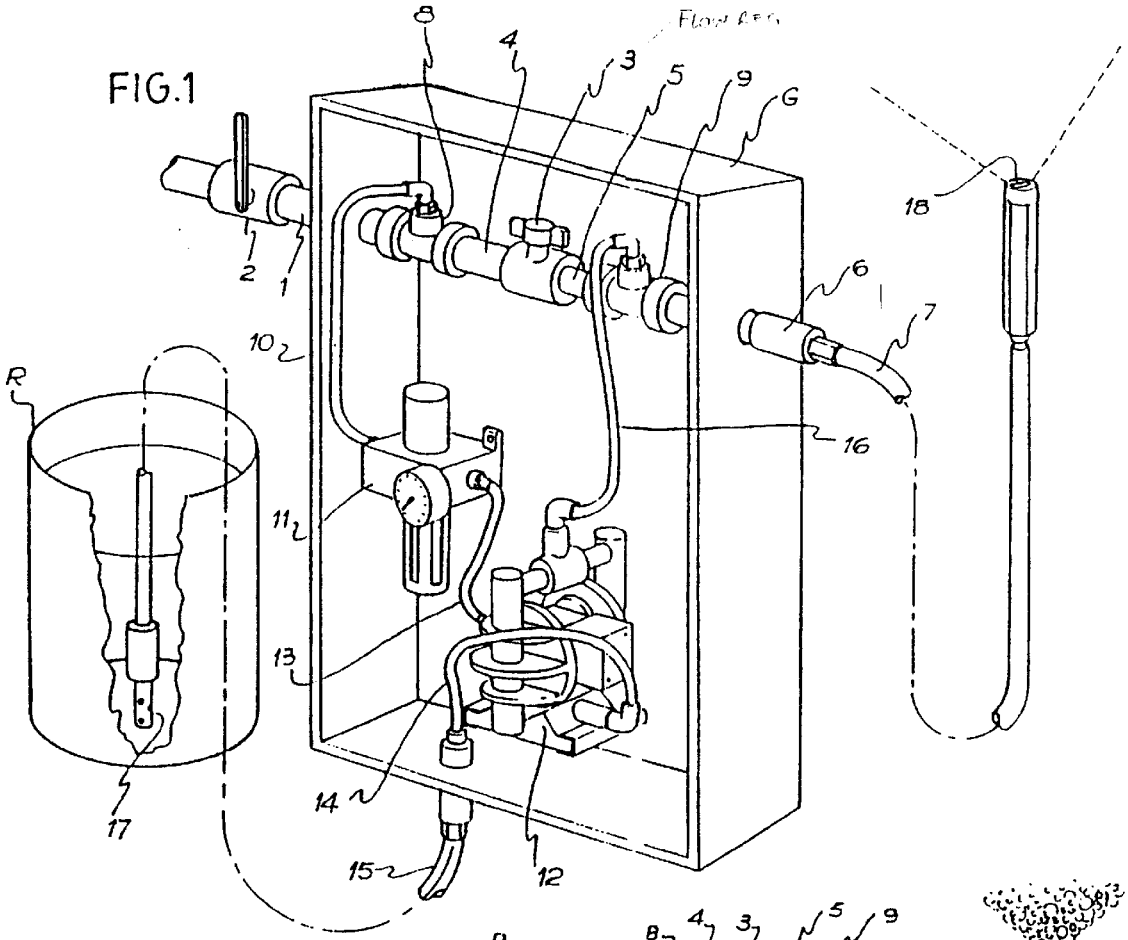
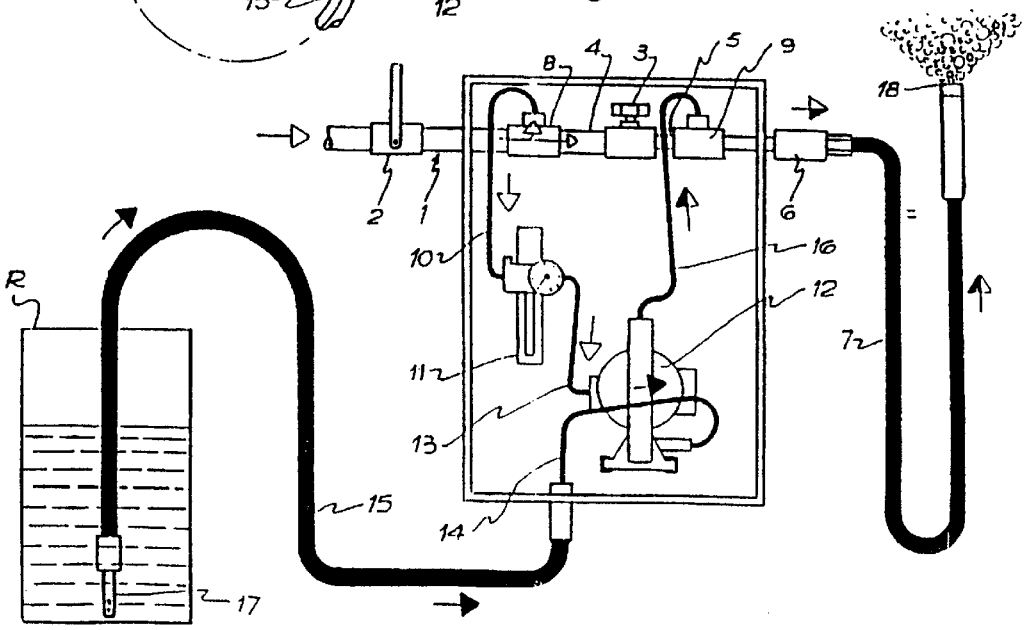
FIG.2

DETERSIVE FOAM PRODUCER AND EXPELLER PNEUMATIC MACHINE

This Appln is a continuation of PCT/EP98/02011 filed Apr. 7, 1998.

TECHNICAL FIELD

The present Patent whose deposit is filed by requesting the corresponding registration refers to a DETERSIVE FOAM PRODUCER AND EXPELLER PNEUMATIC MACHINE, applicable to the washing process of vehicles and large objects.

In synthesis, it consists of a mechanism combining valve pneumatic means with a pressure regulator and a diaphragm pump fed by an air compressor which activates it, and an inflow of detersive tensioactive substance, elements which mix in regular proportion to produce foam and to expel it through a hose fitted with a spreader nozzle.

BACKGROUND ART

As is well known, car washing is carried out by covering the vehicle with detersive foam, following mechanical brushing and rinsing.

The first step of this task requires a foam supply applied at considerable pressure to reach the points most distant from the outlet and also abundant flow to achieve quick covering to activate the process: but this is not what occurs in practice because the machines used at present produce suction of active matter and air, and the ejection of foam formed by an electrical pump, such method being insufficient to achieve the ideal conditions of flow and pressure.

On the other hand, these machines require a rigorous control due to the presence of electrical circuits in highly humid environments as are wash tunnels.

DISCLOSURE OF INVENTION

The aim of the present invention is to optimize the washing process by a combination of elements that solves the disadvantages exposed, having achieved at test 35 liters foam volume with 5kg/cm2 air pressure, starting from 1 liter detergent solution (with 15% active matter) into 100 liters water using a ½" diameter air inlet conduit and ¾" outlet diameter conduit connecting up a 17 mm inner diameter hose.

Specifically, it is about a pneumatic conduit with initial locking valve which is fitted with a smaller section outlet shunt, followed by a flow regulator valve with outlet of section towards a second tube of narrower section in shunt followed by the end of said conduit, to which the outlet hose is coupled.

Off the first shunt a flexible vinculating conduit merges towards a standard pneumatic pressure regulator. Through another flexible conduit, the pressure regulator connects to a diaphragm pump, whose second inlet mouth connects up a hose. Through a bootjack tube, the hose suctions the detersive solution contained in a tank.

Out of the referred double diaphragm pump outlet arises a flexible conduit linking the second shunt of the conduit.

Finally, the ejection hose is fitted with a nozzle of transverse lineal expansion outlet WO88/07,895 and GB-A-2205510 disclose detersive foam producers as described in the preamble of claim 1.

With the elements described, compressed air flow enters the main conduit through the initial valve, partially shifting off the first shunt towards the diaphragm pump, where by action of the pressure regulator the expanded mixture is produced with the detersive solution by effect of its suction along the jackboot tube end introduced into the liquid mass contained in the tank and transported along the hose.

The mentioned mixture, emergent from the pump outlet is carried along the corresponding flexible conduit until it enters the second section of the main conduit through its second shunt. This latter section is narrower than the initial, to maintain the pressure of flow volume diminished at the first shunt, which completes foam formation and expels outside through the hose provided with a lineal opening causing the fan-like dispersing effect.

The flow regulator valve built-in between the first and second section of main conduit allows calibration of the flow/section proportion of ejection to achieve the ideal conditions of outlet pressure and foam density.

BRIEF DESCRIPTION OF THE DRAWINGS

To specify the advantages briefly stated and to allow an easier comprehension of the construction and functioning characteristics of the present invention, there follows the description of a chosen example schematically illustrated in no particular scale in the drawing attached. Expressly stating that, being an example, under no circumstance should it be assigned any limitative or exclusive character but simply a merely illustrative intention of the basical conception on which it is founded.

FIG. 1 is a prospective view of the machine invented, in which the cabinet cover has been removed.

FIG. 2 is a scheme of the machine hydropneumatic circuit.

BEST MODE FOR CARRYING OUT THE INVENTION

In all figures, to equal reference numbers correspond the same or equivalent parts or constitutive elements of the set selected as an example to present the DETERSIVE FOAM PRODUCER AND EXPELLER PNEUMATIC MACHINE.

As shown in FIG. 1, the machine invented consists of a cabinet container (G) into which enters the main pneumatic conduit (1) provided with a blocking valve (2), a flow regulator valve (3) which divides it into two sections (4) and (5), the former having larger section than the latter; a final coupling (6) of the expelling hose (7), a transversal shunt (8) and rear shunt (9).

Off the transversal shunt (8) corresponding to the first section (4) arises a flexible conduit (10) linking the pressure regulator (11) which in turn connects up the diaphragm pump (12) through the flexible conduit (13); coming out of the said pump is another flexible conduit (14) which connects it to the suction hose (15).

A last flexible conduit (16) contacts the diaphragm pump outlet with the described shunt (9) corresponding to the second section (5) of the main conduit (1).

The suction hose mentioned (15) is shown in this figure with its bootjack end (17) immersed in the detersive solution contained in the tank, while the expelling hose (7) distal end has a rectangular mouth nozzle (18) laid out diametrically to produce the fan-like effect of the detersive foam ejection.

The schematized circuit seen in FIG. 2 shows in white arrows the direction of compressed air flow supplied by a compressor, which in shunt 8 deviates part of its flow by the conduit (10) towards the pressure regulator (11) to enter the diaphragm pump (12) by the conduit (13).

Incoming compressed air mixes in the aforementioned pump with detersive solution coming from the tank through the suction hose (15) and conduit (14) in the direction of the black arrows, to produce foaming substance emerging from the conduit. (16) until entering by the shunt (9) section 5, of smaller diameter than section 4, of main conduit.

The referred substance is then washed along the compressed air flow circulating in the direction marked by the mixed arrows, towards the hose ejecting mouth (7) whose regulation is given by the valve (3).

When putting into practice the illustrated and described Detersive Foam Producer and Expeller Pneumatic Machine, further improvements may be introduced which should be considered as realization variants comprehended within the scope of protection of the present Patent of Invention, which in its fundamentals is stated by the text of the following clauses.

What is claimed is:

1. A detersive foam producer and expeller pneumatic machine, comprising:

a) a main conduit formed by first and second sections coupled to both mouths of a flow regulator valve;

b) a first smaller shunt connected to said first section and to a pneumatic pressure regulator;

c) a second smaller shunt connected to said second section and to an outlet mouth of a diaphragm pneumatic pump;

d) said diaphragm pneumatic pump being in connection with said pneumatic pressure regulator and a suction hose coming from a container of detersive solution; and e) a final end of said conduit being connected to an ejection hose.

2. A detersive foam producer and expeller pneumatic machine as in claim wherein said ejection hose is fitted with a spreader nozzle.

3. A detersive foam producer and expeller pneumatic machine as in claim 2, wherein spreader nozzle has a rectangular outlet orifice.

* * * * *